US008857332B2

(12) United States Patent
Knabben et al.

(10) Patent No.: US 8,857,332 B2
(45) Date of Patent: Oct. 14, 2014

(54) ALUMINIUM STRIP FOR LITHOGRAPHIC PRINTING PLATE CARRIERS COMPRISING WATER-BASED COATINGS

(71) Applicants: Stefan Knabben, Bedburg (DE); Bernhard Kernig, Köln (DE); Jochen Hasenclever, Bonn (DE); Gerd Steinhoff, Bonn (DE); Werner Droste, Bonn (DE); Katrin Kuhnke, Solingen (DE)

(72) Inventors: Stefan Knabben, Bedburg (DE); Bernhard Kernig, Köln (DE); Jochen Hasenclever, Bonn (DE); Gerd Steinhoff, Bonn (DE); Werner Droste, Bonn (DE); Katrin Kuhnke, Solingen (DE)

(73) Assignee: Hydro Aluminium Rolled Products GmbH, Grevenbroich (DE)

( * ) Notice: Subject to any disclaimer, the term of this patent is extended or adjusted under 35 U.S.C. 154(b) by 0 days.

(21) Appl. No.: 14/013,927

(22) Filed: Aug. 29, 2013

(65) Prior Publication Data

US 2014/0000469 A1 Jan. 2, 2014

Related U.S. Application Data

(63) Continuation of application No. PCT/EP2012/053591, filed on Mar. 2, 2012.

(30) Foreign Application Priority Data

Mar. 2, 2011 (EP) ..... 11156689

(51) Int. Cl.
*B41N 1/08* (2006.01)
*B22D 25/06* (2006.01)
*B22D 27/00* (2006.01)

(52) U.S. Cl.
CPC ..... *B41N 1/083* (2013.01); *B22D 25/06* (2013.01)
USPC ..... 101/401.1; 148/437; 164/475

(58) Field of Classification Search
CPC ..... B41N 1/083; B22D 25/06; B22D 27/003; B22D 27/006
See application file for complete search history.

(56) References Cited

U.S. PATENT DOCUMENTS

2004/0108021 A1 6/2004 Evans et al.

FOREIGN PATENT DOCUMENTS

| | | | |
|---|---|---|---|
| DE | 19823790 | A1 | 12/1999 |
| DE | 19902527 | A1 | 7/2000 |
| EP | 2 100 677 | A1 | 9/2009 |

*Primary Examiner* — Joshua D Zimmerman
(74) *Attorney, Agent, or Firm* — Reinhart Boerner Van Deuren P.C.

(57) ABSTRACT

The invention relates to an aluminum alloy strip for the production of printing plate carriers comprising water-based coatings, wherein the aluminum alloy strip has a thickness of at most 0.5 mm. The object is to propose an aluminum alloy strip for the production of printing plate carriers comprising at least one water-based coating so that punctiform coating faults are prevented. The object is achieved for an aluminum alloy strip in that the aluminum alloy strip, in a longitudinal polished section prepared using water as a lubricant, has etch figures with a cubic etching, of which the longitudinal extent is at most 15 mm.

10 Claims, 3 Drawing Sheets

ALUMINIUM STRIP FOR LITHOGRAPHIC PRINTING PLATE CARRIERS COMPRISING WATER-BASED COATINGS

CROSS-REFERENCE TO RELATED PATENT APPLICATIONS

This patent application is a continuation of International Application No. PCT/EP2012/053591 filed on Mar. 2, 2012, which claims the benefit of EP application No. 11156689.9 filed on Mar. 2, 2011, the teachings and disclosure of which are hereby incorporated in their entirety by reference thereto.

FIELD OF THE INVENTION

The invention relates to an aluminium alloy strip for the production of printing plate carriers comprising water-based coatings, wherein the aluminium alloy strip has a thickness of at most 0.5 mm. In addition, the invention relates to the use of sheets separated from the aluminium alloy strip for printing plate carriers and to a method for producing an aluminium alloy strip according to the invention.

BACKGROUND OF THE INVENTION

Aluminium alloy strips for lithographic printing plate carriers, which for example are produced from alloys of the AA1050, AM100, AA3103, AlMg0.5 type and from other alloy types, are not only subject to high mechanical demands in respect of ongoing use as printing plate carriers. Once the aluminium alloy strips have been roughened, said strips normally having a thickness on at most 0.5 mm, they are provided with coatings, which are photosensitive and/or thermosensitive and thus enable the transfer of images or texts that are to be printed. In order to meet the increasing demands in terms of minimal environmental impact, water-based coatings are used increasingly. Water-based coatings contain water instead of conventionally used organic solvents in order to apply the coating substance to the sheet. Water-containing coatings are also included by this term in the present invention, however. The at least one water-based coating is applied to the aluminium alloy strip or sheet such that, once the water has evaporated, a correspondingly photosensitive or thermosensitive layer remains on the aluminium strip or the sheet produced therefrom. With use of these water-based coatings, it was found that intensified punctiform faults occur in the coating, and that the corresponding areas could no longer be duly exposed and decoated. Corresponding printing plate carriers are not suitable for subsequent use and therefore constitute waste. This phenomenon has become established in particular with CTP printing plate carriers, which are not subject to a development process with use of developer chemicals.

SUMMARY OF THE INVENTION

On this basis, one object of the present invention is to propose an aluminium alloy strip for the production of printing plate carriers comprising a water-based coating, such that punctiform coating faults are prevented. A further object of the present invention is to propose an advantageous use of the aluminium alloy strip and also a method for producing the aluminium alloy strip.

In accordance with a first teaching of the present invention, the stated object for an aluminium alloy strip is achieved in that the aluminium alloy strip, in a longitudinal polished section prepared using water as a lubricant, has etch figures with a cubic etching, of which the longitudinal extent is at most 15 μm.

It has been found that there is a correlation between the occurrence of punctiform faults on printing plate carriers coated with water-based coatings and the occurrence of etch figures, with a cubic etching with a specific longitudinal extent, in the case of preparation from longitudinal polished sections using water as a lubricant. It is assumed that the etch figures with a cubic etching occurring in the case of preparation with water as a lubricant are to be attributed to the presence of chlorous components, for example chlorides, in the aluminium alloy strip. If a coating process is carried out with a water-based coating, the water reacts with the chlorine present to form hydrochloric acid, which leaves behind the typical, cubic etch figures in the aluminium matrix. It has been found that etch figures with a longitudinal extent of at most 15 μm do not lead to surface faults influencing the print image of the printing plate carriers. Printing plate carriers produced from the aluminium alloy strip according to the invention comprising a water-based coating therefore have no faults in the print image. The presence of etch figures with greater longitudinal extent leads automatically to the occurrence of faults in the printing plates.

A further increase in the process reliability can be ensured since the aluminium alloy strip, in a longitudinal polished section prepared with water as a lubricant, has etch figures with a cubic etching with a longitudinal extent of at most 10 μm, more preferably at most 5 μm. The smaller the etch figures with a cubic etching, the lower are the quantities of chlorine remaining in the aluminium alloy strip and therefore also the likelihood for the formation of misprints.

In accordance with a first embodiment of the aluminium alloy strip according to the invention, the number of etch figures with a cubic etching over 1000 $mm^2$ is at most 350. As a result of the limitation of the number of etch figures per 1000 $mm^2$, the likelihood that a plurality of etch figures in close proximity will lead to a misprint is reduced.

Printing plate carriers have to fulfil specific properties. High reverse bending strengths, but also a certain flexibility, ensure a high number of printing operations with a printing plate. These objectives can be achieved via the alloy composition. To this end, the aluminium alloy is preferably alloyed with magnesium, manganese and silicon. The aluminium alloy strip can therefore be further improved in accordance with a further embodiment in that the aluminium alloy strip consists of an aluminium alloy with the following alloy components in percentage by weight:

| | |
|---|---|
| 0.05% ≤ | Mg ≤ 1%,<br>Mn ≤ 0.6%,<br>Fe ≤ 1%,<br>Si 0.5%,<br>Cu ≤ 0.04%,<br>Ti ≤ 0.04%, |

unavoidable impurities, individually not exceeding 0.01%, in total not exceeding 0.05%, and the remainder being Al.

The aluminium alloy strip may preferably consist of an aluminium alloy with the following alloy components:

| | |
|---|---|
| 0.05% ≤ | Mg ≤ 0.3%,<br>Mn ≤ 0.3%, |
| 0.4% ≤ | Fe ≤ 1%, |
| 0.05% ≤ | Si ≤ 0.5%,<br>Cu ≤ 0.04%,<br>Ti ≤ 0.04%, |

unavoidable impurities, individually not exceeding 0.01%, in total not exceeding 0.05%, and the remainder being Al.

A further embodiment of the aluminium alloy strip can be provided in that the aluminium alloy of the aluminium alloy strip comprises the following alloy components in percentage by weight:

| | |
|---|---|
| 0.1% ≤ | Mg ≤ 0.6%, |
| | Mn ≤ 0.05%, |
| 0.3% ≤ | Fe ≤ 0.4%, |
| 0.05% ≤ | Si ≤ 0.25%, |
| | Cu ≤ 0.04%, |
| | Ti ≤ 0.04%, |

unavoidable impurities, individually not exceeding 0.01%, in total not exceeding 0.05%, and the remainder being Al.

The alternative aluminium alloy strip just mentioned preferably has a Mg content of 0.1% by weight—0.3% by weight or 0.3% by weight—0.6% by weight. The higher Mg contents of 0.3% by weight to 0.6% by weight are intended for aluminium alloy strips which, in operation, are to provide greater strength and bending strength. The limitation of the Mg content from 0.1% by weight to 0.3% by weight leads to high reverse bending strength, thermal stability and also a very good roughening behaviour with average strengths of the aluminium alloy strip with constant parameters during the production of the aluminium alloy strip.

As already mentioned, the limitation of the longitudinal extent of the cubic etch figures means that printing plate carriers produced from the aluminium alloy strips according to the invention have no punctiform misprints, which is to be attributed to an etching with the presence of chlorine impurities. In this regard, the use of sheets separated from an aluminium alloy strip according to the invention for printing plate carriers comprising at least one water-based coating is also advantageous.

In addition, the use of sheets separated from an aluminium alloy strip according to the invention for printing plate carriers is advantageous if said printing plate carriers are thermoprinting plate carriers, since thermoprinting plate carriers are increasingly produced with use of water-based coatings.

In accordance with a third teaching of the present invention, the above-stated object for a method for producing an aluminium alloy strip according to the invention from an aluminium alloy is achieved, wherein the method for producing the strip comprises the following steps:

- Fusing an aluminium master alloy with use of rolling scraps, pigs, liquid metal from the bottom of the furnace, recycled metal and/or master alloys,
- Alloying alloy components in order to achieve the desired composition of the aluminium alloy,
- Transferring the aluminium alloy into a melting furnace or casting furnace for melt treatment,
- Performing gas flushing in the melting or casting furnace,
- Stripping the slag and killing the melt, and
- Degassing the aluminium alloy melt when casting the rolling ingot or the cast strip.

The steps just mentioned are the conventional method steps when producing an aluminium alloy required for the production of the aluminium alloy strip.

In accordance with the invention, the above-stated problem is achieved in that the aluminium alloy, during casting, is degassed in a degasser with chlorine gas, wherein a quantity of chlorine of at most 7 mg Cl/kg Al is added to the melt.

Comprehensive tests have shown that the degassing of the melt during casting in a degasser, for example with use of a multi-chamber rotor degasser, constitutes a particularly critical source for the contamination of the aluminium alloy with chlorine, since a solidified rolling ingot or a solidified cast strip is provided immediately subsequently to the casting process. Chlorine is fed into the degasser in order to again purify the aluminium alloy melt to be cast and for example to reduce the contents of sodium, lithium and calcium. After the degasser, the aluminium alloy melt normally passes through a filter, which comprises a packed fed filter or a ceramic foam filter. Due to the limitation of the quantity of chlorine, which is fed into the degasser in order to purify the melt, the proportion of chlorine in the aluminium alloy and thus in the finished aluminium alloy strip is reduced. It is assumed that, due to the reduced quantity of chlorine remaining in the aluminium alloy strip produced in accordance with the invention and enclosed in pores, the size of the etch figures with a cubic etching, as occur under the influence of water, for example with preparation of longitudinal polished sections with water as a lubricant, can be limited to a longitudinal extent of at most 15 μm. As a result, printing plate carriers that can be provided in a fault-free manner with water-based coatings without the tendency for punctiform misprints can be produced from aluminium alloy strips produced in accordance with the invention, without a tendency for punctiform misprints. The quantity of chlorine is preferably reduced to 2 to 4 mg Cl/kg Al in order to further reduce the contamination of the aluminium alloy with chlorine and to further diminish the etch figures in the aluminium alloy strip with a cubic etching.

In accordance with a further embodiment of the method according to the invention, the gas flushing in the melting or casting furnace is carried out with the addition of chlorine, wherein the fed quantity of chlorine is at most 40 mg Cl/kg Al. The quantity of chlorine introduced during the gas flushing in the melting or casting furnace also plays a role for the occurrence of misprints in the printing plate carriers. As a result of the gas flushing in the melting or casting furnace with the addition of chlorine, the content of sodium and calcium in the aluminium melt is further reduced. If the fed quantity of chlorine is limited to at most 40 mg Cl/kg Al, etch figures with a cubic etching measuring at most 15 μm in size can be ensured in spite of the addition of chlorine in the gas flushing in the melting or casting furnace. With a reduction of the quantity of chlorine to 30 mg Cl/kg Al, a further degassing process can also be carried out in the degasser with the addition of chlorine, without exceeding an elongation extent of 15 μm of the etch figures. As a result, an aluminium alloy strip produced from a correspondingly treated aluminium alloy melt can be provided for printing plate carriers comprising water-based coatings.

In accordance with a next alternative embodiment of the method according the invention, no chlorine gas is used with the gas flushing in the melting or casting furnace and with the degassing during the casting in the degasser. The melt is purified of sodium, lithium and calcium components by the addition of salts, in particular chlorides, preferably potassium chloride/magnesium chloride, wherein a quantity of at most 60 mg Cl/kg Al can be added to the aluminium alloy melt. The gas flushings in the melting or casting furnace and also the degassing during the casting in the degasser are carried out in this case for example with the use argon and possibly with the addition of further inert gases, such as nitrogen. The addition of potassium chloride/magnesium chloride, for example in a quantity such that, at most, 60 mg Cl/kg Al are added to the aluminium alloy melt, enables sufficient purification without the result that the chlorine residues in the aluminium melt lead to etch figures with a cubic etching and a longitudinal extent of more than 15 μm. Aluminium alloy strips produced from this aluminium alloy melt are particularly suitable for the use as printing plate carriers comprising water-based coatings, since punctiform misprints are eliminated.

BRIEF DESCRIPTION OF THE DRAWINGS

The invention will be explained in greater detail hereinafter on the basis of exemplary embodiments in conjunction with the drawing, in which:

FIG. 1, in a schematic flow diagram, shows the production steps of aluminium alloy strips, as are required for printing plate carriers. Firstly, in method step 1, the aluminium alloy consisting of primary aluminium is fused and is fused with the use of rolling scraps, pigs, liquid metal from the bottom of the furnace, or recycled metal or other master alloys to form an aluminium alloy melt. Additional alloy components, such as magnesium, manganese or other alloy components, can then be alloyed into the fused aluminium alloy in order to achieve the desired composition of the aluminium alloy.

Figure 1:
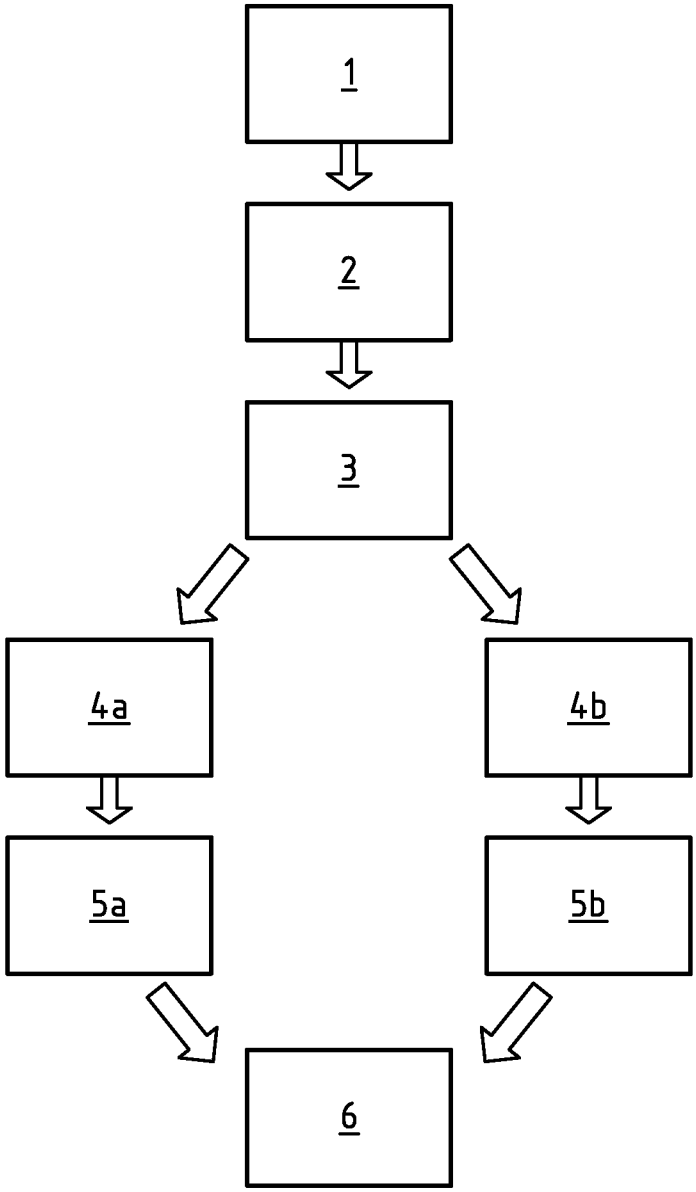
FIG. 1 shows a schematic flow diagram of a production method for printing plate carriers.

The aluminium alloy is then transferred into the casting or melting furnace, in which, in accordance with method step 2, a selective melt treatment is then carried out, in particular to purify the aluminium alloy melt. Gas flushings are carried out as melt treatment 2 in the casting or melting furnace. The melt is then stripped, that is to say the components floating on the melt are suctioned off or skimmed off and the slag is removed. By killing the aluminium alloy melt, the gasses introduced by the gas flushing into the aluminium melt also escape, thus resulting in a further purification.

The melt treatment 2 in the casting or melting furnace is normally carried out with the addition of chlorine, since chlorine has the property of removing effectively from the aluminium alloy melt even the lowest concentrations of sodium, lithium and calcium components of the aluminium alloy melt as a result of the formation of the corresponding salts, which have reached the melt via impurities. The sodium, lithium and/or calcium content of the aluminium and alloy melt can thus be reduced to a few ppm.

The aluminium alloy melt is cast to form a rolling ingot 4*a* or to form a cast strip 4*b* via a degasser, which is normally arranged in the channel system required for casting. The objective of the degassing 3 of the aluminium alloy melt in the degasser, which is often formed as a multi-chamber rotor degasser and is arranged upstream of a filtration stage, is to again purify the aluminium alloy melt in order to remove undesirable alloy components, in particular again sodium, lithium and/calcium components. Chlorine gas is therefore normally also used in the degassing step 3.

The aluminium alloy strip 6 is produced by means of rolling 5*a*,5*b* from the rolling ingots produced by casting 4*a* or from the cast strips produced by casting 4*b*. The aluminium alloy strips 6 produced are electrochemically roughened and are provided with a water-based coating so that the aluminium alloy strip 6 cut into sheets can be used as printing plate carriers, for example as thermoprinting plates.

Nine different aluminium alloy strips nos. 1-9 were produced by production of the aluminium alloy, casting of a rolling ingot 4*a* and rolling 5*a* of the rolling ingot to form the aluminium alloy strip 6. Table 1 shows the sample alloys nos. 1-9 and their composition.

TABLE 1

| Sample no. | Strip | | Si | Fe | Cu | Mn | Mg | Cr | Zn | Ti | B |
|---|---|---|---|---|---|---|---|---|---|---|---|
| 1 | S1 | Comp. | 0.0798% | 0.3633% | 0.0013% | 0.0040% | 0.2120% | 0.0011% | 0.0088% | 0.0069% | 0.0005% |
| 2 | S3 | Comp. | 0.0796% | 0.3644% | 0.0013% | 0.0040% | 0.2183% | 0.0010% | 0.0085% | 0.0067% | 0.0004% |
| 3 | S4 | Comp. | 0.0855% | 0.3488% | 0.0014% | 0.0035% | 0.1895% | 0.0008% | 0.0099% | 0.0079% | 0.0002% |
| 4 | S5 | Comp. | 0.0855% | 0.3488% | 0.0014% | 0.0035% | 0.1895% | 0.0008% | 0.0099% | 0.0079% | 0.0002% |
| 5 | S7 | Inv. | 0.0807% | 0.3716% | 0.0012% | 0.0039% | 0.2163% | 0.0005% | 0.0069% | 0.0067% | 0.0007% |
| 6 | S8 | Inv. | 0.0981% | 0.3747% | 0.0013% | 0.0032% | 0.2152% | 0.0010% | 0.0098% | 0.0062% | 0.0004% |
| 7 | S9 | Inv. | 0.0836% | 0.3658% | 0.0013% | 0.0031% | 0.2196% | 0.0007% | 0.0077% | 0.0063% | 0.0004% |
| 8 | S10 | Inv. | 0.0895% | 0.3810% | 0.0040% | 0.0040% | 0.2086% | 0.0008% | 0.0118% | 0.0071% | 0.0002% |
| 9 | S16 | Inv. | 0.0849% | 0.3536% | 0.0042% | 0.0042% | 0.2010% | 0.0008% | 0.0094% | 0.0091% | 0.0003% |

Sample alloys nos. 1-9 were produced with the use of six methods M0 to M5, which are characterised by method steps 1, 2 and 3 from FIG. 1.

In method M0 with the production of the aluminium alloy by fusion, no quantities of chlorine were thus introduced into the melt by means of the addition of salts. This was also true for methods M1, M2, M3 and M4. In method M0, the gas flushing in the melting furnace was then carried out with 34 mg Cl/kg Al. In the degasser, which was formed as a multi-chamber rotor degasser, the fed quantity of chlorine was then 6.6 mg Cl/kg Al.

In method M1, 40 mg Cl/kg Al were fed to the aluminium melt during the gas flushing in the melting furnace, and 12 mg Cl/kg Al were fed to the aluminium melt during the degassing in the degasser.

In method M2, the use of chlorine was omitted, both in the form of a salt additive and by means of gas addition during the gas flushing or in the degasser of the aluminium melt. This was also true for method M4.

In method M3, the quantity of chlorine in the gas flushing in the melting furnace was reduced to 20 mg Cl/kg Al, and the quantity of chlorine fed to the aluminium melt in the degasser was adjusted to the value of 6.6 mg Cl/kg Al.

Method M5 differed from methods M0 to M4 by the addition of salts during the fusion process and alloying of the aluminium alloy in step 1 from FIG. 1 in an amount of 60 mg Cl/kg Al. No chlorine was added in method M5 in the subsequent steps of furnace flushing and degassing.

TABLE 2

| Method | | Strip | Quantity of chlorine by salt addition (mg Cl/kg Al) | Quantity of chlorine furnace flushing (mg Cl/kg Al) | Quantity of chlorine in the degasser (mg Cl/kg Al) |
|---|---|---|---|---|---|
| M0 | Comparison | S1, S3 | 0 | 34 | 6.6 |
| M1 | Comparison | S4, S5 | 0 | 40 | 12 |
| M2 | Invention | S10 | 0 | 0 | 0 |
| M3 | Invention | S8, S9 | 0 | 20 | 6.6 |
| M4 | Invention | S16 | 0 | 0 | 0 |
| M5 | Invention | S7 | 60 | 0 | 0 |

The assignment of the aluminium alloy strips S1 to S16 to the production methods M0 to M5 is illustrated in Table 2. In each case, samples from the strips S1 to S16 were cut out lengthwise with respect to the rolling direction and longitudinal polished sections were prepared for examination under microscope. To this end, a plurality of strips were first cut out from the respective strips S1 to S16, such that said strips had a cutting edge parallel to the rolling direction. The strips 7 were positioned in a sample holder 8 and embedded with epoxy resin 9 such that the upwardly pointing edge corresponded to the cutting edge in the rolling direction.

Figure 2:
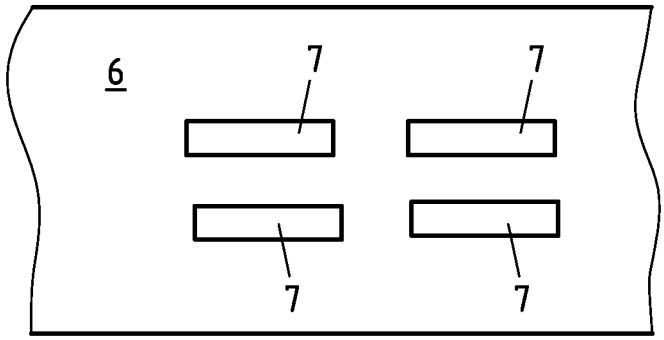
FIG. 2 shows a schematic plan view of an aluminium alloy strip with sketched strips for the creation of longitudinal polished sections.

FIG. 2 shows how strips 7 formed from an aluminium alloy strip 6 can be prepared in order to produce longitudinal polished sections of the aluminium alloy strip. As can be seen, a plurality of strips 7 are detached directly from an aluminium alloy strip and are then arranged in a sample holder 8.

Figure 3:
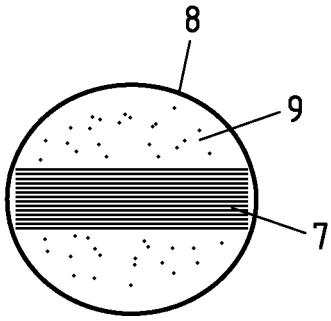
FIG. 3 shows a schematic plan view of a sample holder for creating longitudinal polished sections.
Figure 4:
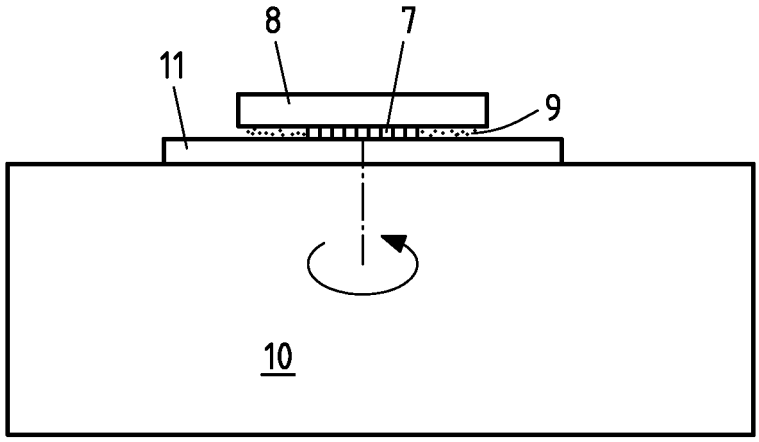
FIG. 4 shows a schematic side view of a grinding machine with an applied sample.

As is shown in FIG. 3 in a plan view of a sample holder 8 with cast longitudinal strip 7, the edge faces point upwardly from the longitudinal strip 7. If the sample holder 8 is applied headfirst to a polishing station 10 with a polishing plate 11 for polishing, the cut edges then pointing downwardly can be polished to form longitudinal polished sections The device for polishing the longitudinal strips is illustrated merely schematically in FIG. 4 in a side view. The rotating abrasive wheel 11 is covered with an abrasive paper of increasing grit size. SIC paper with a grit size of 120 is initially used until the samples in the sample holder 8 have a planar surface. Water is used as a lubricant in each abrasive step. The grit size of the abrasive wheels is then increased successively from 500 to 1000 and subsequently to an abrasive cloth with a grit size of approximately 2400, wherein the period of abrasion was approximately 10-20 sec. and water was again used as a lubricant.

Further polishing steps were carried out on semi-automatic polishing machines of similar design using a medium-hard cotton cloth with a polycrystalline diamond suspension with 6 μm grit size and then with a cotton cloth with a 3 μm polycrystalline diamond suspension for a period of approximately 8-9 min. In this step, media based on alcohol and on oil, such as "lubrikant Blau" ("lubricant blue") and "lubrikant Rot" ("lubricant red") were used as a lubricant.

After each polishing step, the samples were cleaned under flowing water with a rinsing agent and were then dried with ethanol with a supply of warm air. Final polishing was carried out with a synthetic plastic fibre cloth in conjunction with a 0.25 μm oxide polishing suspension and the lubricant (water) for a period of 2-5 minutes.

The longitudinal polished sections thus produced were examined and evaluated under microscope with 500 times magnification in the unetched state. During the evaluation, only the number of etch figures with a cubic etching, that is to say the etch figures to be attributed to the presence of chlorine, was counted and the size thereof determined. The size of the etch figures was assessed as "large" if etch figures with a cubic etching were present that exceeded a longitudinal extent of 30 μm. The etch figures with a cubic etching that had a longitudinal extent of more than 15 μm to 30 μm were referred to as "medium". By contrast, etch figures with a maximum longitudinal extent of 15 μm were referred to as "small" etch figures. Since the evaluated areas of the longitudinal polished sections deviated, the found number of etch figures with a cubic etching was extrapolated to an area of 1000 $mm^2$ At the same time, printing plate carriers with at least one water-based coating were produced from the produced aluminium strips, and the occurrence of misprints was assessed. An unacceptable printing result was characterised by a "–", an acceptable printing result was characterised by "o", and a good printing result was characterised by "+". In the case of the unacceptable printing results, punctiform coating faults distorted the printing result so severely that the printing plates were not useable. The results of the tested aluminium strips are summarised in Table 3.

It was found that the occurrence of etch figures with a cubic etching exceeding a size of more than 15 μm in longitudinal extent correlated with an unacceptable printing result of the coated printing plate carriers.

TABLE 3

| Sample no. | Strip | Method | No. of etch figures over 1000 $mm^2$ | Size of the etch figures | Printing result |
|---|---|---|---|---|---|
| 1 | S1 | M0 | 1089 | large | – |
| 2 | S3 | M0 | 298 | large | – |
| 3 | S4 | M1 | 1245 | medium | – |
| 4 | S5 | M1 | 985 | medium | – |
| 5 | S7 | M5 | 42 | small | + |
| 6 | S8 | M3 | 45 | small | 0 |
| 7 | S9 | M3 | 287 | small | 0 |
| 8 | S10 | M2 | 194 | small | + |
| 9 | S16 | M4 | 226 | small | + |

Comparative sample nos. 1, 2, 3 and 4 presented medium to large etch figures with a cubic etching. The number of medium and large etch figures with a cubic etching was between 1089 and 298. As a result, comparative sample nos. 1, 2, 3 and 4 led to an unacceptable printing result, since there were punctiform misprints in the coating.

By contrast, sample nos. 5-9 according to the invention presented etch figures with a cubic etching that had a longitudinal extent of less than 15 μm. Although the number of etch figures in comparative sample no. 2 and no. 7 according to the invention were practically identical, the size of the etch figures was reflected in an unacceptable printing result in comparative sample no. 2.

Figure 6:
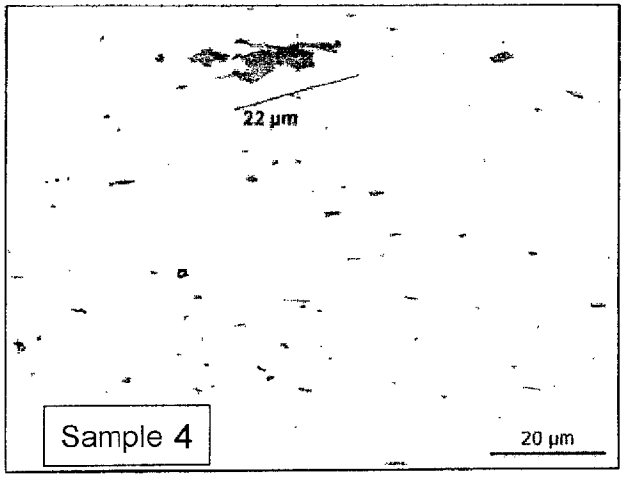
FIGS. 5, 6 show longitudinal polished sections, enlarged under a microscope, of conventional aluminium alloy strips.
Figure 5:
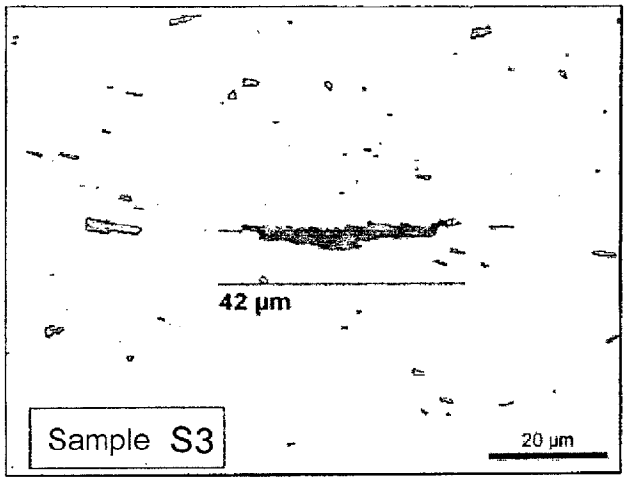
Figure 7:
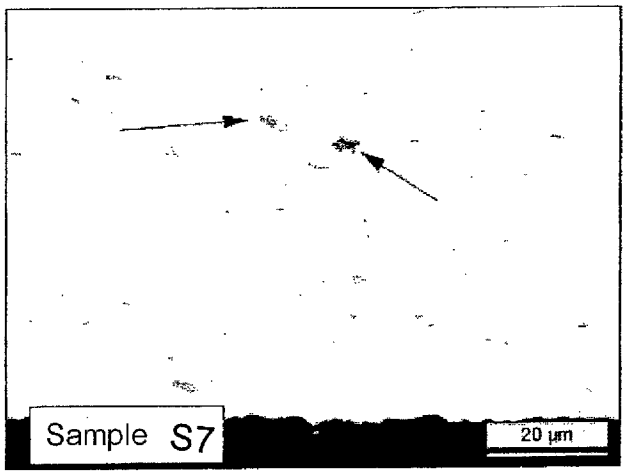
FIG. 7 shows a longitudinal polished section, enlarged under a microscope, of an exemplary embodiment of the present invention.

For example, FIG. 5 shows a considerably enlarged detail of a longitudinal polished section of sample S3. An etch figure that has a cubic etching and a longitudinal extent of 42 μm can be seen clearly. The cubic etching is typical for the presence of chlorine atoms or chlorine clusters, which react in conjunction with water to form hydrochloric acid and leave behind typical etch patterns in the aluminium crystal structure. FIG. 6 shows an etch figure with a cubic etching, which has a medium size and likewise leads to an unacceptable fault on the printing plate carriers coated with water-based coatings. The longitudinal extent of this etch figure was 22 μm. By contrast, an exemplary embodiment according to the invention, which is illustrated in FIG. 7, prevents extremely small etch figures with a cubic etching with a size of less than 5 μm. The sample S7 was assessed positively in the coating tests.

As can be seen on the basis of Table 3 in conjunction with Table 2, the reduction of the quantity of chlorine in the production of the aluminium alloy leads to a reduction of the number, but also to a reduction of the longitudinal extent, of the etch figures with a cubic etching in the longitudinal polished section prepared with water as a lubricant. This reduction of the size of the etch figures with a cubic etching in the longitudinal polished section correlated to the disappearance of the occurrence of punctiform faults on the printing plate carriers coated with water-based coatings.

It was found that the addition of chlorine in the degasser, in the present case a multi-chamber rotor degasser was used, is to be considered critical before the casting of the rolling ingot. Here, even small amounts of Cl/kg Al were sufficient in order to lead to misprints in conjunction with water-based coatings of the printing plate carriers. By contrast, a greater amount of Cl/kg Al can be used when fusing the aluminium alloy or also in the event of the gas flushing in the melting or casting furnace, as is shown in particular by method M3. Aluminium alloy strips according to the invention are therefore outstandingly suitable for the production of printing plate carriers with water-based coatings, since they effectively reduce the occurrence of punctiform coating faults caused by chemical reactions with locally present chlorine components.

The invention claimed is:

1. An aluminium alloy strip for the production of printing plate carriers comprising water-based coatings, wherein the aluminium alloy strip has a thickness of at most 0.5 mm, wherein the aluminium alloy strip, in a longitudinal polished section prepared using water as a lubricant, has etch figures with a cubic etching, of which the longitudinal extent is at most 15 μm.

2. The aluminium alloy strip according to claim 1, wherein the number of etch figures with a cubic etching over 1000 $mm^2$ is at most 350.

3. The aluminium alloy strip according to claim 1, wherein the aluminium alloy strip consists of an aluminium alloy with the following alloy components in percentage by weight:

| | |
|---|---|
| 0.05% ≤ | Mg ≤ 1%,<br>Mn ≤ 0.6%,<br>Fe ≤ 1%,<br>Si 0.5%,<br>Cu ≤ 0.04%,<br>Ti ≤ 0.04%, |

unavoidable impurities, individually not exceeding 0.01%, in total not exceeding 0.05%, and the remainder being Al.

4. The aluminium alloy strip according to claim 3, wherein the aluminium alloy strip consists of an aluminium alloy with the following alloy components in percentage by weight:

| | |
|---|---|
| 0.05% ≤ | Mg ≤ 0.3%,<br>Mn ≤ 0.3%, |
| 0.4% ≤ | Fe ≤ 1%, |
| 0.05% ≤ | Si ≤ 0.5%,<br>Cu ≤ 0.04%,<br>Ti ≤ 0.04%, |

unavoidable impurities, individually not exceeding 0.01%, in total not exceeding 0.05%, and the remainder being Al.

5. The aluminium alloy strip according to claim 3, wherein the aluminium alloy comprises the following alloy components in percentage by weight:

| | |
|---|---|
| 0.1% ≤ | Mg ≤ 0.6%,<br>Mn ≤ 0.05%, |
| 0.3% ≤ | Fe ≤ 0.4%, |
| 0.05% ≤ | Si ≤ 0.25%,<br>Cu ≤ 0.04%,<br>Ti ≤ 0.04%, |

unavoidable impurities, individually not exceeding 0.01%, in total not exceeding 0.05%, and the remainder being Al.

6. Use of sheets separated from an aluminium alloy strip according to claim 1 for printing plate carriers comprising at least one water-based coating.

7. The use according to claim 6, wherein the printing plate carrier is a thermoprinting plate carrier.

8. A method for producing an aluminium alloy strip according to claim 1 formed from an aluminium alloy, wherein the method for producing the strip comprises the following steps:

Fusing an aluminium master alloy with use of rolling scraps, pigs, liquid metal from the bottom of the furnace, recycled metal and/or master alloys, Alloying alloy components in order to achieve the desired composition of the aluminium alloy, Transferring the aluminium alloy into a melting furnace or casting furnace for melt treatment, Performing gas flushing in the melting or casting furnace, Stripping the slag and killing the melt, and Degassing the aluminium alloy melt during the casting process, wherein the aluminium alloy, during casting, is degassed in a degasser with chlorine gas, wherein a quantity of chlorine of at most 7 mg Cl/kg Al is fed to the melt.

9. The method according to claim 8, wherein the gas flushing in the melting or casting furnace is carried out with the addition of chlorine, wherein the quantity of fed chlorine is at most 30 mg Cl/kg Al.

10. The method according to claim 8, wherein alternatively, no chlorine gas is used with the gas flushing in the melting or casting furnace and with the degassing during the casting in the degasser, and the melt is purified by feeding chlorides, preferably potassium chloride/magnesium chloride, wherein a quantity of at most 60 mg Cl/kg Al is fed to the aluminium alloy melt.

* * * * *